US009653236B2

(12) United States Patent
Hiraiwa et al.

(10) Patent No.: US 9,653,236 B2
(45) Date of Patent: May 16, 2017

(54) ELECTROMAGNETIC RELAY

(71) Applicant: FUJITSU COMPONENT LIMITED, Tokyo (JP)

(72) Inventors: Nobuyoshi Hiraiwa, Tokyo (JP); Yasushi Saito, Tokyo (JP); Kazutaka Nagamine, Tokyo (JP); Yuki Kakoiyama, Tokyo (JP); Yanfeng Wu, Tokyo (JP)

(73) Assignee: FUJITSU COMPONENT LIMITED, Tokyo (JP)

( * ) Notice: Subject to any disclaimer, the term of this patent is extended or adjusted under 35 U.S.C. 154(b) by 0 days.

(21) Appl. No.: 14/232,798

(22) PCT Filed: Jun. 28, 2013

(86) PCT No.: PCT/JP2013/067909
§ 371 (c)(1),
(2) Date: Jan. 14, 2014

(87) PCT Pub. No.: WO2014/007180
PCT Pub. Date: Jan. 9, 2014

(65) Prior Publication Data

US 2014/0151337 A1 Jun. 5, 2014

(30) Foreign Application Priority Data

Jul. 4, 2012 (JP) ..... 2012-150644

(51) Int. Cl.
*H01H 33/18* (2006.01)
*H01H 9/36* (2006.01)
(Continued)

(52) U.S. Cl.
CPC ..... *H01H 33/182* (2013.01); *H01H 9/36* (2013.01); *H01H 9/443* (2013.01); *H01H 50/546* (2013.01)

(58) Field of Classification Search
CPC ..... H01H 9/44; H01H 9/443; H01H 33/18; H01H 33/182; H01H 33/187; H01H 9/36; H01H 50/546
(Continued)

(56) References Cited

U.S. PATENT DOCUMENTS 4,367,448 A * 1/1983 Nishizako ..... 335/201
4,404,443 A * 9/1983 Coynel et al. ..... 218/23
(Continued)

FOREIGN PATENT DOCUMENTS

JP 6-22415 1/1994
JP 6-22087 3/1994
(Continued)

OTHER PUBLICATIONS

International Search Report mailed Aug. 6, 2013 in corresponding International Application No. PCT/JP2013/067909.
(Continued)

*Primary Examiner* — Renee Luebke
*Assistant Examiner* — William Bolton
(74) *Attorney, Agent, or Firm* — Staas & Halsey LLP

(57) ABSTRACT

An electromagnetic relay which is improved in arc blocking performance without being increased in size is desired. An electromagnetic relay according to the present invention is provided with a fixed contact, a moving contact which is movable respect to the fixed contact, a pair of magnets which is arranged at the side of the fixed contact and the moving contact so that pole faces with mutually reversed polarity are separated from and face each other and a pair of arc cooling plates which is arranged in a spaces between the magnets and which has first surfaces which face each other across a gap and second surfaces which face a pole face of either of the magnets, respectively.

6 Claims, 5 Drawing Sheets

(51) Int. Cl.
*H01H 9/44* (2006.01)
*H01H 50/54* (2006.01)

(58) Field of Classification Search
USPC ..... 218/22, 23, 24, 25, 26; 335/78, 201
See application file for complete search history.

(56) References Cited

U.S. PATENT DOCUMENTS

| | | | | |
|---|---|---|---|---|
| 4,866,227 | A | 9/1989 | Toguchi et al. | |
| 5,546,061 | A | 8/1996 | Okabayashi et al. | |
| 7,259,646 | B2 * | 8/2007 | Rab et al. | 335/201 |
| 7,541,902 | B2 * | 6/2009 | Domejean | H01H 9/346 335/201 |
| 8,519,292 | B2 * | 8/2013 | Domejean | 218/23 |
| 8,946,580 | B2 * | 2/2015 | Hoffmann et al. | 218/26 |
| 2012/0161908 | A1 * | 6/2012 | Naka et al. | 335/78 |
| 2012/0181860 | A1 * | 7/2012 | Hsu et al. | 307/10.1 |
| 2013/0214881 | A1 | 8/2013 | Ito et al. | |

FOREIGN PATENT DOCUMENTS

| | | | |
|---|---|---|---|
| JP | 7-235248 | | 9/1995 |
| JP | 10-154458 | | 6/1998 |
| JP | 2002-251934 | | 9/2002 |
| JP | 2002-334644 | | 11/2002 |
| JP | 2003-272465 | | 9/2003 |
| JP | 2009-230921 | | 10/2009 |
| JP | 2011-129385 | | 6/2011 |
| JP | 2011-204476 | | 10/2011 |
| JP | 2012-104366 | | 5/2012 |
| WO | 2012/060090 | A1 | 5/2012 |

OTHER PUBLICATIONS

Office Action dated Feb. 16, 2015 in corresponding Korean Patent Application No. 10-2014-7002768.
Extended European Search Report dated Feb. 22, 2016 in corresponding to European Patent Application No. 13813654.4.
Office Action dated Feb. 24, 2016 in corresponding Japanese Patent Application No. 2012-150644.

* cited by examiner

ELECTROMAGNETIC RELAY

TECHNICAL FIELD

This application claims the foreign priority benefit of Japanese Application No. 2012-150644 filed Jul. 4, 2012 which serves as priority for PCT Application No. JP2013/067909 filed Jun. 28, 2013, the contents of both are incorporated herein by reference.

The present invention relates to an electromagnetic relay.

BACKGROUND ART

In an electromagnetic relay which is used inside a circuit of a high voltage battery of an electric vehicle or large-sized direct current device etc., sometimes the arc discharge which occurs at the time the contacts are opened (hereinafter simply referred to as an "arc") causes the conduction state to be maintained and prevents the circuit from being broken. Further, even if the circuit is broken, the arc sometimes causes wear of contacts or melting of the contacts or other problems. Therefore, to secure the performance which is demanded from an electromagnetic relay which is used for a direct current high voltage circuit, it is essential to improve the arc extinguishing performance. Patent documents 1 to 4 disclose electromagnetic relays which are provided with devices for extinguishing the arcs which are generated at the time the contacts open or methods of extinguishing the arcs.

Patent document 1 discloses a method of extinguishing an arc which is generated in a space which is formed when a moving contact separates from a fixed contact when the moving contact and the fixed contact are opened (hereinafter referred to as a "contact gap") by using permanent magnets to apply magnetic force in a perpendicular direction to the arc so as to pull the arc from a contact portion to a non-contact portion and thereby extend the arc length and smoothly cut the arc. However, with the method of Patent document 1, just the magnetic forces of permanent magnets are used to make the arc move from a contact portion to a non-contact portion, so the permanent magnets which are required for extinguishing the arc becomes larger and, along with this, the electromagnetic relay itself becomes larger in size.

Further, Patent document 2 discloses a plunger-type potential relay which has a ceramic plate chamber which faces a contact gap and which is provided by indentation, in the axial direction, of the surface of the inside wall of the housing present at a position perpendicular to the pole face of a permanent magnet and which has an arc resistance plate which has a ceramic as a material embedded in the ceramic plate chamber. With the method of Patent document 2, an arc-resistance plate is set at the place to which the arc moves, so sufficient stretching of the arc length is obstructed. Further, if arranging the arc resistance plate further separated from the contact gap so as to secure sufficient stretching of the arc length, the contact becomes larger in size.

Patent document 3 discloses a sealed contact device which provides an arc extinguishing grid near a moving contact and a fixed contact. The arc extinguishing grid of the sealed contact device of this third patent literature is one where "several to several tens of 0.2 to 0.3 mm or so metal sheets are stacked. Between the individual metal sheets, there is a gap of several mm. These metal sheets, as shown in FIG. 3, are supported by support plates 38, 40 (39, 41) which are comprised of ceramic etc. and are arranged as shown in FIG. 2". Support plates for superposition of the metal sheets with gaps between them become further necessary, so the contact becomes larger in size.

Patent document 4 discloses a sealed contact device which seals in hydrogen gas or another electrical insulating gas and operates the contact inside a hermetically formed sealed container. The cooling ability of the electrical insulating gas and the arc extinguishing action of permanent magnets which are arranged outside of the sealed container are used to quickly extinguish the generated arc. The method of Patent document 4 requires equipment for sealing in hydrogen gas or another electrical insulating gas. To prevent the electrical insulating gas from passing through, it is necessary to seal the container by a metal, ceramic, etc. Therefore, the cost rises.

PRIOR ART DOCUMENT

Patent Document

Patent document 1: Japanese Patent Publication No. 2002-334644A

Patent document 2: Japanese Patent Publication No. 7-235248A

Patent document 3: Japanese Patent Publication No. 6-22415A

Patent document 4: Japanese Patent Publication No. 6-22087B2

SUMMARY

Technical Problem

An electromagnetic relay which is improved in arc blocking performance without being increased in size is desired.

Solution to Problem

The aspect of the invention which is set forth in claim 1 provides an electromagnetic relay which is provided with a fixed contact, a moving contact movable with respect to the fixed contact, a pair of magnets which is arranged at the side of the fixed contact and the moving contact so that mutually opposite pole faces are separated from and face each other and which pulls in an arc which is generated between the fixed contacts and the moving contact to a space between the pole faces, and a pair of arc cooling plates which are arranged in the spaces and which has first surfaces which face each other across a gap and second surfaces at the opposite sides to the first surfaces, which second surfaces face the pole faces of either of the magnets, an arc which is pulled into the space being pulled into the gap and contacting a first surface of at least one of the arc cooling plates.

The aspect of the invention which is set forth in claim 2 provides the electromagnetic relay as set forth in claim 1 wherein the pair of arc cooling plates is made of a ceramic.

The aspect of the invention which is set forth in claim 3 provides the electromagnetic relay as set forth in claim 1 or 2 wherein yokes are displaced adjacent to the surfaces of the pair of magnets at opposite sides to the pole faces.

The aspect of the invention which is set forth in claim 4 provides the electromagnetic relay as set forth in any one of claims 1 to 3 wherein the pair of arc cooling plates is arranged so that the gap becomes narrower further away from the fixed contact and the moving contact.

Effects of the Invention

In the electromagnetic relay according to the present invention, between pole faces an arc which is pulled into a space between pole faces contacts the first surface of at least one of the arc cooling plates. For this reason, arcs which are generated by fixed contacts and moving contacts are cooled and extinguished by contact with the arc cooling plates. Further, high temperature arcs are extinguished by contact with arc cooling plates in the stretched state, so the loads on the arc cooling plates become smaller and it is possible to prevent damage to the arc cooling plates by the arcs.

DESCRIPTION OF EMBODIMENTS

Below, the attached figures will be referred to so as to explain the embodiments of the present invention. In the following embodiments, the same or similar members are shown assigned common reference signs. Further, it should be noted that the technical scope of the present invention is not limited to these embodiments and extends to the inventions which are described in the claims and their equivalents.

Figure 1:
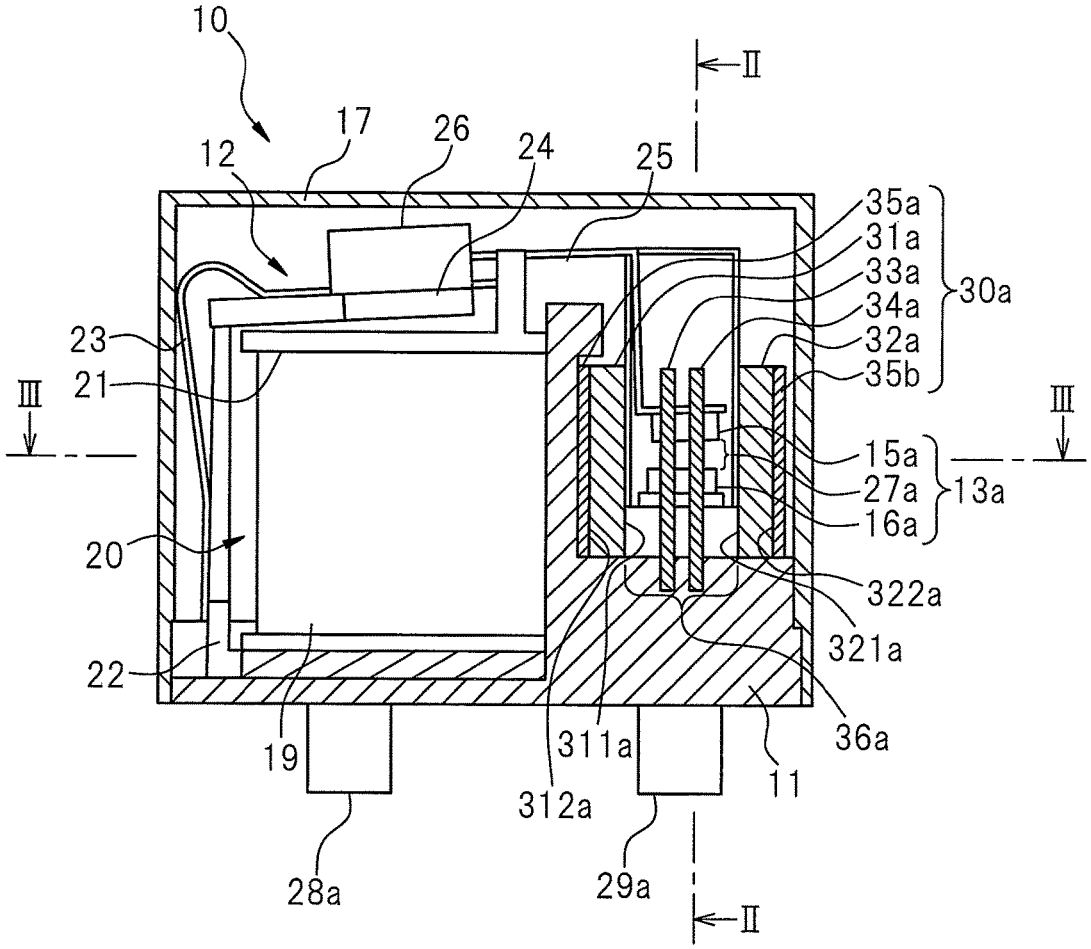
FIG. 1 A cross-sectional view showing an electromagnetic relay according to an embodiment of the present invention FIG. 2 A cross-sectional view along the line II-II of FIG. 1

FIG. 1 is a cross-sectional view which shows the configuration of an electromagnetic relay 10 according to an embodiment of the present invention, FIG.

Figure 3:
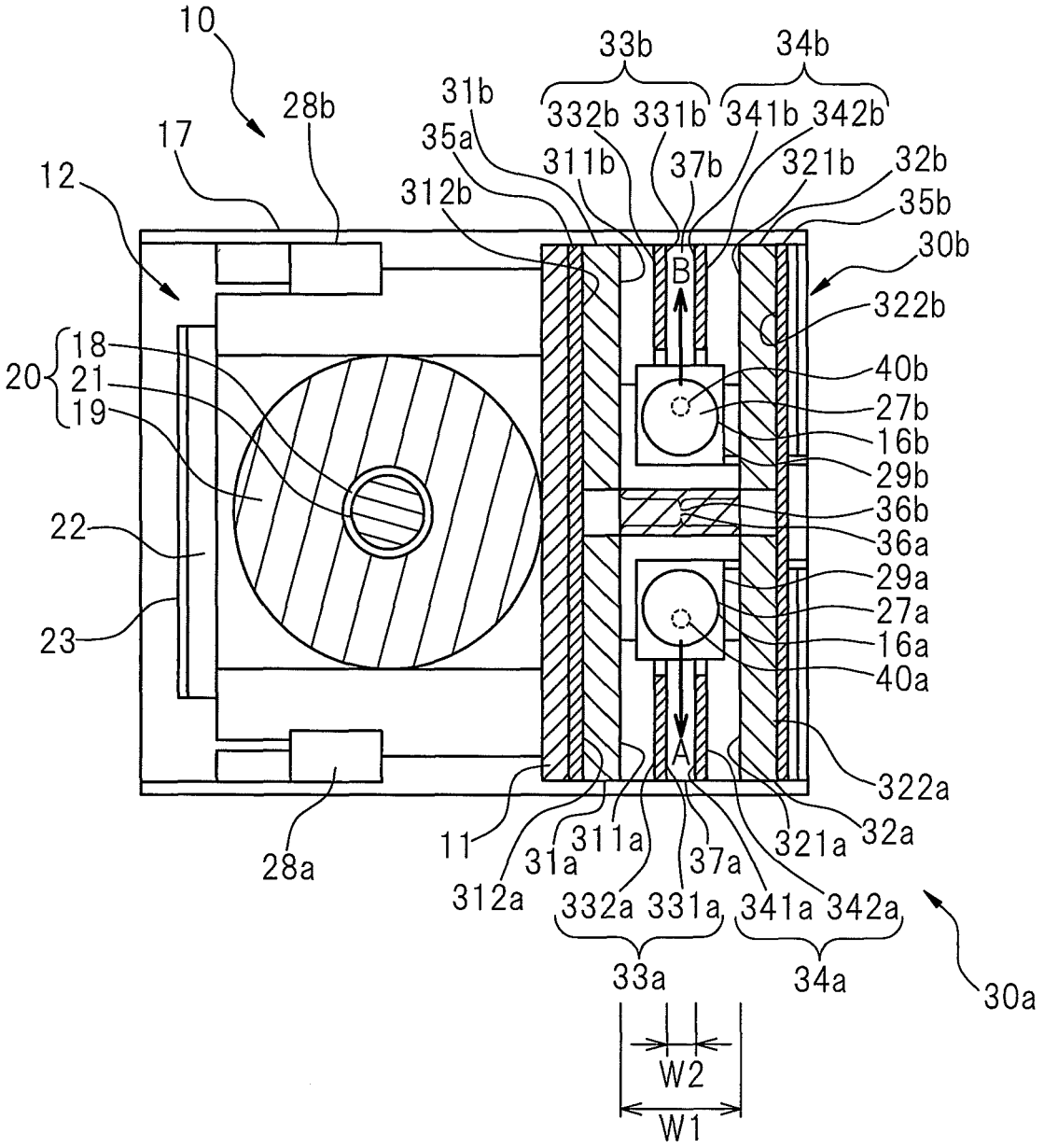
FIG. 3 A cross-sectional view along the line III-III of FIG. 1

2 is a cross-sectional view along the line II-II of FIG. 1, and FIG. 3 is a cross-sectional view along the line III-III of FIG. 1. The electromagnetic relay 10 of the present embodiment comprises a base 11, an electromagnet block 12, contacts 13*a*, 13*b* (hereinafter sometimes collectively referred to as "contacts 13") which include two fixed contacts 16*a*, 16*b* (hereinafter sometimes together referred to as "fixed contacts 16") and moving contacts 15*a*, 15*b* (hereinafter sometimes together referred to as "moving contacts 15") which move with respect to the fixed contacts 16*a*, 16*b* and contact the fixed contacts 16*a*, 16*b*, arc extinguishing parts 30*a*, 30*b* which extinguish arcs which are generated at the contacts 13*a*, 13*b*, and a cover 17 which encloses the electromagnet block 12, contacts 13, and arc extinguishing parts 30*a*, 30*b*.

The electromagnet block 12 comprises a yoke 22 which is arranged on the base 11, an electromagnet 20, a hinge spring 23, an armature 24 which is provided at the front end of the hinge spring 23, and an insulator 26 which is arranged on the armature 24. The electromagnet 20 comprises a bobbin 21, a coil 19 which is wound around the outer circumference of the bobbin 21, and a core 18 which is arranged at the inner circumference of the bobbin 21. Further, at the bottom of the base, coil terminals 28*a*, 28*b* which extend from the coil 19 are provided. Note that, the illustrated configuration of the electromagnet block 12 is one example. The electromagnet block may also be configured in other ways.

The contacts 13 include two moving contacts 15*a*, 15*b* and fixed contacts 16*a*, 16*b* as explained above. The moving contacts 15*a*, 15*b* are fastened to a moving spring 25 which moves linked together with the armature 24. Further, at the bottom of the base 11, fixed terminals 29*a*, 29*b* which are linked with one of the fixed contacts 16*a*, 16*b* respectively are provided (see FIG. 2).

By the electromagnet 20 of the electromagnet block 12 being excited or demagnetized and a movement of the armature 24, the moving spring 25 moves linked together with the armature 24, and the moving contacts 15 and the fixed contacts 16 contact or separate. When the armature 24 descends and the moving contacts 15 and the fixed contacts 16 contact, current flows, for example, in the arrow F direction of FIG. 2 from the fixed terminal 29*a* to pass through the contacting fixed contact 16*a* and moving contact 15*a*, passes via the moving spring 25 through the contacting moving contact 15*b* and fixed contact 16*b*, and reaches the fixed terminal 29*b*.

Figure 2:
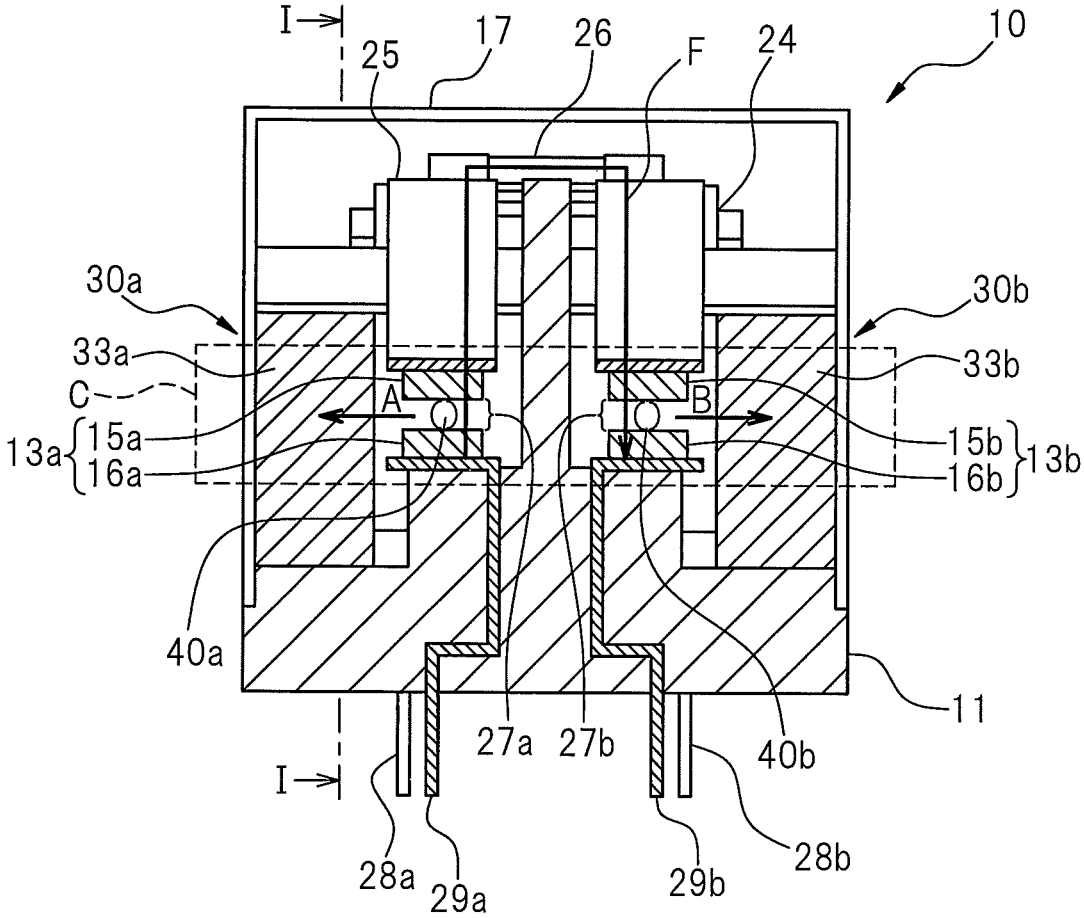

By the moving spring 25 rising in the upward direction in FIG. 2, the moving contacts 15*a*, 15*b* move upward and the moving contacts 15*a*, 15*b* and fixed contacts 16*a*, 16*b* separate, respectively. Due to this separation, as shown in FIG. 2, contact gaps 27*a*, 27*b* are formed between the contacts and the current which flows in the arrow F direction is cut off. However, when the moving contacts 15 and the fixed contacts 16 separate, sometimes arcs 40*a*, 40*b* (hereinafter sometimes collectively referred to as "arcs 40") are generated at the contact gaps 27*a*, 27*b*.

Figure 4:
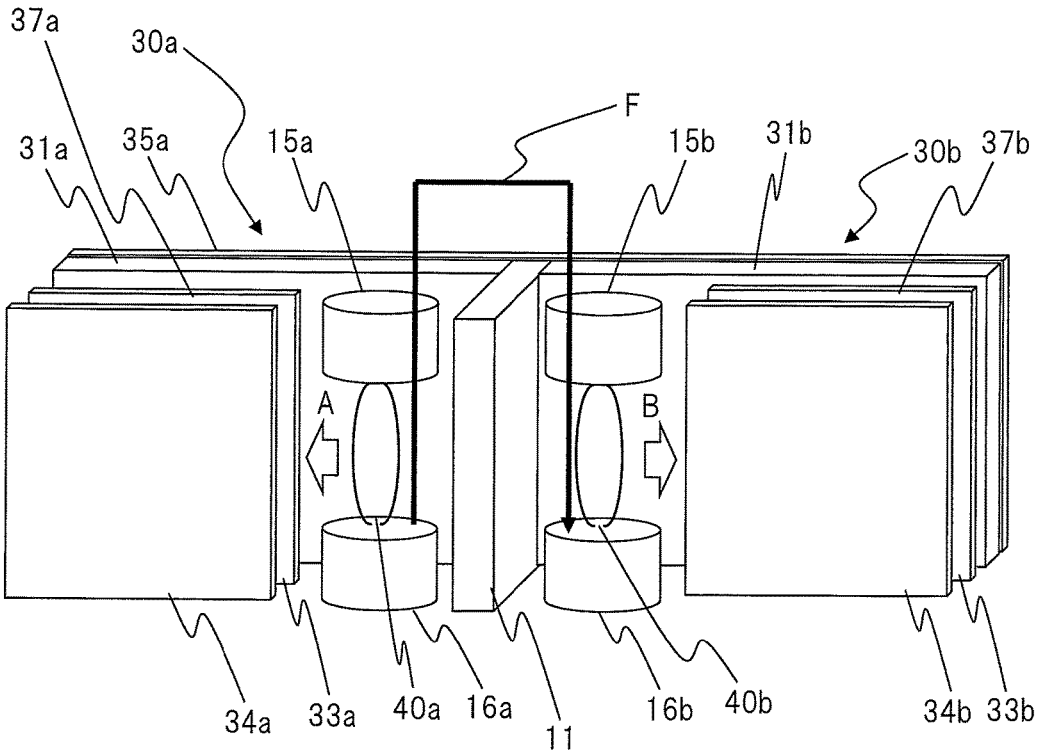
FIG. 4 A perspective view showing part of the electromagnetic relay enlarged FIG. 5 A plan view showing another example of an arc extinguishing part of an electromagnetic relay.

The arc extinguishing parts 30*a*, 30*b* which the electromagnetic relay 10 of the present embodiment is provided with will be explained with reference to FIG. 1, FIG. 3, and FIG. 4. FIG. 4 is a perspective view which enlarges the part C surrounded by the broken line in FIG.

2 and shows the arc extinguishing parts 30*a*, 30*b*, but part of the components are omitted so as to show the structures of the arc extinguishing parts 30*a*, 30*b*.

The electromagnetic relay 10 of the present embodiment is provided with two arc extinguishing parts 30*a*, 30*b* so as to extinguish the arcs 40*a*, 40*b* which are generated at two contact gaps 27*a*, 27*b*. The arc extinguishing part 30*a* and the arc extinguishing part 30*b* only differ in direction in which the arcs 40 are stretched by the magnetic field. The rests of the configurations are substantially the same.

The arc extinguishing part 30*a*, as shown in the drawing, is provided with a pair of permanent magnets 31*a*, 32*a* of plate shapes. The permanent magnets 31*a*, 32*a* are arranged so as to be separated from and face each other at the sides of the moving contact 15*a* and fixed contact 16*a* across the contact gap 27*a* so that each polarity of the pole faces 311*a*, 321*a* which face each other becomes opposite, in other words, N-pole face of one permanent magnet and S-pole face of the other permanent magnet face each other.

By having the reversed pole faces of the pair of permanent magnets 31*a*, 32*a* which face each other, arranged facing each other across a certain interval W1, a magnetic field is generated in a space 36*a*. Since a magnetic field is generated in the space 36*a*, a Lorentz force acts on the arc 40*a* generated by the current flowing from the fixed contact 16*a* to the moving contact 15*a*, the arc 40*a* is stretched in the arrow A direction, and the arc 40*a* is pulled into the space 36*a*.

The arc extinguishing part 30*a* is provided with a pair of arc cooling plates 33*a*, 34*a*. The pair of arc cooling plates 33*a*, 34*a* has first surfaces 331*a*, 341*a* which face each other across a gap 37*a* and second surfaces 332*a*, 342*a* at the opposite sides of the first surfaces 331*a*, 341*a*. Further, the second surface 332*a* of the arc cooling plate 33*a* faces the pole face 311*a* of the permanent magnet 31*a*, while the second surface 342*a* of the arc cooling plate 34*a* faces the pole face 321*a* of the permanent magnet 32*a*.

As shown in FIG. 1 and FIG. 3, the pair of arc cooling plates 33*a*, 34*a* is arranged inside the space 36*a* between the permanent magnets 31*a*, 32*a* while facing each other across a gap 37*a* of a certain interval W2 so as to sandwich the arc 40*a* which is generated at the contact gap 27*a* and which is stretched by the magnetic forces of the pair of permanent magnets 31*a*, 32*a*. The arc 40*a* which is stretched by the permanent magnets 31*a*, 32*a* and is pulled into the space 36*a* is pulled inside of the gap 37*a* of the pair of arc cooling plates 33*a*, 34*a*.

In the illustrated embodiment, the pair of arc cooling plates 33*a*, 34*a* is arranged to become substantially parallel to the permanent magnets 31*a*, 32*a*. The arc cooling plates 33*a*, 34*a* are arranged across the gap 37*a* so as to sandwich the stretched arc 40*a*, so the stretching of the arc 40*a* is not obstructed much at all. The arc 40*a* which is pulled into the gap 37*a* is cooled and extinguished by contacting at least one of the mutually facing first surfaces 331*a*, 341*a* of the arc cooling plates 33*a*, 34*a*. The arc 40*a* is high in heat, so if striking the cooling plates 33*a*, 34*a*, the arc cooling plates 33*a*, 34*a* may be damaged by the heat of the arc 40*a*. In the configuration of the present embodiment, the arc 40*a* is stretched and cooled to a certain extent inside the space 36*a*, then contacts the arc cooling plates 33*a*, 34*a* inside the gap 37*a*, so damage to the arc cooling plates 33*a*, 34*a* can be prevented. The arc cooling plates 33*a*, 34*a* of the illustrated embodiment are made of ceramic, so their effect on the magnetic field inside the space 36*a* is small. Even after the arc 40*a* is pulled into the gap 37*a* of the arc cooling plates 33*a*, 34*a*, it is stretched by the magnetic field.

Further, at the surfaces 312*a*, 322*a* of the permanent magnets 31*a*, 32*a* at the opposite sides to the pole faces 311*a*, 321*a*, as shown in FIG. 1 and FIG. 3, yokes 35*a*, 35*b* are set. By setting the yokes 35*a*, 35*b* at the surfaces 312*a*, 322*a* of the permanent magnets 31*a*, 32*a*, a uniform magnetic field is obtained at the space 36*a*. In the illustrated embodiment, the contact gap 27*a* is offset in position from the center part of the space 36*a*, but by arranging the yokes 35*a*, 35*b*, even at the position of the contact gap 27, a uniform magnetic field is obtained in the same way as the center part of the space 36*a*, the strength of the magnetic forces which are applied to the arc 40*a* which is generated at the contact gap 27*a* increase, and the arc 40*a* can be stretched more stably.

Note that, the pair of permanent magnets 31*a*, 32*a* need only be arranged in proximity to the contact gap 27*a*. They do not necessarily have to be arranged so as to sandwich the contact gap 27*a* so long as the arc 40*a* can be pulled into the space 36*a*. However, if the pair of permanent magnets 31*a*, 32*a* are arranged so as to sandwich the contact gap 27, the magnetic field becomes stronger and the arc 40*a* can be more stably pulled into the space 36*a*, so this is preferable. Further, the permanent magnets 31*a*, 32*a* are examples of the magnets. For example, electromagnets may also be used to generate the magnetic field.

The other arc extinguishing part 30*b*, as shown in FIG. 3, is provided with a pair of permanent magnets 31*b*, 32*b* of plate shapes which are arranged so as to be separated from and face each other at the sides of the moving contact 15*b* and fixed contact 16*b* across the contact gap 27*b* so that the polarities of the pole faces 311*b*, 321*b* become opposite (so that N-pole face and S-pole face each other).

By having the mutually opposite pole faces 311*b*, 321*b* of the pair of permanent magnets 31*b*, 32*b* arranged facing each other across a certain interval W1, a space 36*b* is formed in which a magnetic field is generated. Since the magnetic field is generated in the space 36*b*, a Lorentz force acts on arc 40*b* of the current flowing from the moving contact 15*b* to the fixed contact 16*b* which was generated at the contact gap 27*b*, the arc 40*b* is stretched in the arrow B direction, and the arc 40*b* is pulled into the space 36*b*.

The arc extinguishing part 30*b* is provided with a pair of arc cooling plates 33*b*, 34*b*. The pair of arc cooling plates 33*b*, 34*b* has first surfaces 331*b*, 341*b* which face each other across a gap 37*b* and second surfaces 332*b*, 342*b* at opposite sides to the first surfaces 331*b*, 341*b*. Further, the second surface 332*b* of the arc cooling plate 33*b* faces the pole face 311*b* of the permanent magnet 31*b*, while the second surface 342*b* of the arc cooling plate 34*b* faces the pole face 321*b* of the permanent magnet 32*b*.

As shown in FIG. 3, the pair of arc cooling plates 33*b*, 34*b* are arranged facing each other across a predetermined interval W2 inside a space 36*b* between the permanent magnets 31*b*, 32*b* so as to form a contact gap 27*b* and sandwich an arc 40*b* which is stretched by the magnet forces of the pair of permanent magnets 31*b*, 32*b*. Further, the pair of arc cooling plates 33*b*, 34*b* are arranged so as to become substantially parallel to the permanent magnets 31*b*, 32*b*. The arc 40*b* which is stretched by the magnetic field of the permanent magnets 31*b*, 32*b*, is pulled into the space 36*b*, and is pulled into the gap 37*b* of the first surface 331*b* of the arc cooling plate 33*b* and the arc cooling plate 34*b* is cooled and extinguished by contacting at least one of the first surface 331*b* of the arc cooling plate 33*b* and the first surface 341*b* of the arc cooling plate 34*b*.

At the surfaces 312*b*, 322*b* of the permanent magnets 31*b*, 32*b* at the opposite sides to the space 36*b*, as shown in FIG. 3, yokes 35*a*, 35*b* are arranged. By arranging the yokes 35*a*, 35*b* at the outside surfaces 312*b*, 322*b* of the permanent magnets 31*b*, 32*b*, a uniform magnetic field is obtained at the space 36*b*. By arranging the yokes 35*a*, 35*b*, a uniform magnetic field is obtained at the contact gap 27*b* as well in the same way as the center part of the space 36*b*, the strength of the magnetic forces which are applied to the arc 40*b* which is generated at the contact gap 27*b* is increased, and the arc 40*b* can be stretched more stably. Note that, in the illustrated embodiment, the arc extinguishing part 30*a* and the arc extinguishing part 30*b* share the yokes 35*a*, 35*b*, but separate yokes may also be provided.

Note that, the electromagnetic relay 10 of the illustrated embodiment is configured so as to extinguish the arcs 40*a*, 40*b* which are generated at the two contact gaps 27*a*, 27*b*, but it may also be configured so that only one of the contact gaps is provided with an arc extinguishing part for extinguishing an arc.

The material of the arc cooling plates is preferably a ceramic in consideration of the insulation and heat resistance. However, the material for arc cooling use is not limited to this. When the heat resistance in the case of contact with the arc is sufficiently secured, another material, for example, a heat resistant plastic, may also be used for forming the plates.

In the arc extinguishing parts 30*a*, 30*b* which are shown in FIGS. 1 to 4, the pairs of arc cooling plates 33*a*, 34*a* and arc cooling plates 33*b*, 34*b* were arranged so as to become mutually parallel at a certain interval W2. However, the method of arranging the arc cooling plates 33*a*, 34*a*, 33*b*, 34*b* is not limited to this.

Figure 5:
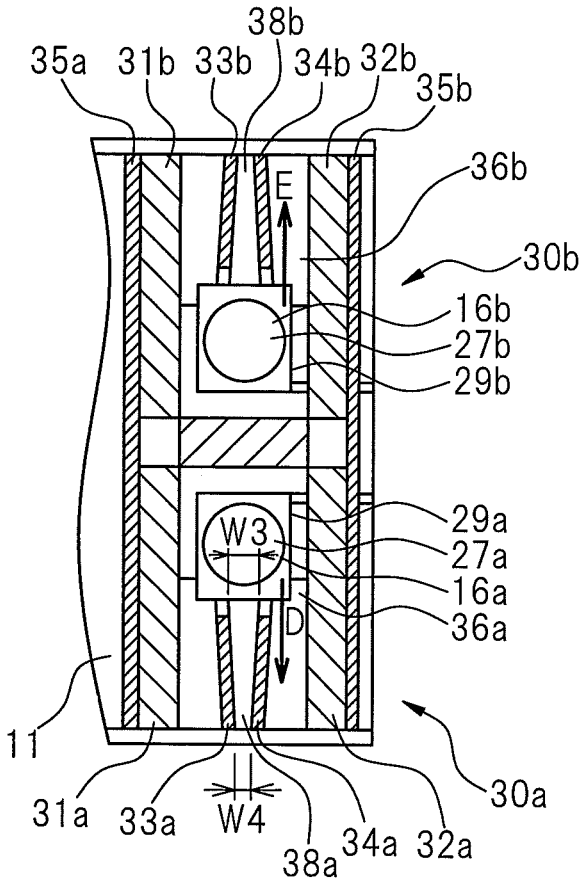

For example, as shown in FIG. 5, the arc cooling plates may be arranged so that the widths of the intervals between the facing pairs of arc cooling plates become narrower the further from the contact gaps 27*a*, 27*b*, in other words, so that compared with the interval W3 between the arc cooling plate 33*a* and the arc cooling plate 34*a* near the contact gap

27*a*, the interval W4 between the arc cooling plate 33*a* and the arc cooling plate 34*a* positioned the furthest from the contact gap 27*a* becomes smaller. In the spaces 36*a*, 36*b*, due to the heat at the time when the arcs 40*a*, 40*b* are generated, the air around the contact gaps 27*a*, 27*b* is warmed. A temperature difference with respect to the air of the outsides 38*a*, 38*b* of the spaces 36*a*, 36*b* is formed, so a pressure difference is formed between spaces 36*a*, 36*b* and spaces 38*a*, 38*b* and the air inside of the spaces 36*a*, 36*b* flows in the arrow D direction or arrow E direction of FIG. 5. Furthermore, by narrowing the gap between the arc cooling plates 33*a*, 34*a* or the gap between the arc cooling plates 33*b*, 34*b*, the flow of air becomes faster and the arcs 40*a*, 40*b* can be stretched more to extinguish them. That is, by stretching the arcs 40*a*, 40*b* which are generated at the contact gaps 27*a*, 27*b* to the narrower width spaces (outsides 38*a*, 38*b*), due to the Venturi effect (an effect of ejecting the fluid, such as air or liquid, out of the small tube by a pressure differential, when running fluid to the small tube from a wide space), the flow rate of the surrounding air increases and the arcs 40*a*, 40*b* can be stretched more.

Above, drawings were used to explain the electromagnetic relay according to the present embodiment. Like the prior art, when using only magnets to extinguish arcs, a certain amount of space was necessary for making the arcs naturally extinguish, but like the electromagnetic relay according to the present embodiment, by using arc cooling plates, it is possible to reduce the spaces between the pole faces, i.e., the arc extinguishing part provided at the electromagnetic relay of the present embodiment is comprised of arc cooling plates which are arranged facing each other so as to sandwich a stretched arc between them, so it is possible to extinguish an arc without impairing the stretching of the arc. By providing the pair of arc cooling plates in the space of a magnetic field which is formed by magnets, it is possible to further reduce the size of the space for extinguishing the arc. The electromagnetic relay is not increased in size. Further, the electromagnetic relay according to the present embodiment does not use hydrogen gas or another inert gas for an arc cooling effect, so there is no need to make the surroundings of the contacts of the electromagnetic relay hermetically sealed and inexpensive production is possible. In other words, a configuration for sealing in the gas is not required and inexpensive production of an electromagnetic relay which is improved in arc blocking performance becomes possible.

DESCRIPTION OF REFERENCE SIGNS

10 Relay
12 Electromagnet block
13*a*, 13*b* Contact
15*a*, 15*b* Moving contact
16*a*, 16*b* Fixed contact
30*a*, 30*b* Arc extinguishing part
31*a*, 32*a*, 31*b*, 32*b* Permanent magnet
33*a*, 34*a*, 33*b*, 34*b* Arc cooling plate
35*a*, 35*b* Yoke

The invention claimed is:

1. An electromagnetic relay comprising:

a fixed contact;

a moving contact, movable with respect to the fixed contact, the moving and fixed contacts each having a diameter;

a pair of magnets arranged so as to sandwich the fixed contact and the moving contact, pole faces of the pair of magnets with mutually reversed polarity being separated from and facing each other; and a pair of arc cooling plates which is arranged in a space between the pair of magnets at a position apart from the fixed contact and the moving contact, so as not to sandwich the fixed contact and the moving contact, in a direction in which an arc generated between the fixed contact and the moving contact is stretched by a magnetic field of the pair of magnets with a gap, smaller than the diameter of the moving and fixed contacts, defined between and separating the pair of arc cooling plates, the pair of arc cooling plates having a first surface and a second surface, the first surface of the pair of arc cooling plates facing each other across the gap, and the second surface of the pair of arc cooling plates facing a pole face of either of the pair of magnets.

2. The electromagnetic relay according to claim 1, wherein the pair of arc cooling plates are made of a ceramic.

3. The electromagnetic relay according to claim 1, wherein yokes are disposed adjacent to surfaces opposite to the pole faces of the pair of magnets which face each other.

4. The electromagnetic relay according to claim 1, wherein the pair of arc cooling plates is arranged so that the gap becomes narrower further away from the fixed contact and the moving contact.

5. The electromagnetic relay according to claim 1, wherein each arc cooling plate is configured to cool the arc which contacts the arc cooling plate.

6. The electromagnetic relay according to claim 1, wherein each of the arc cooling plates has a first end arranged at a position apart from the fixed contact and the moving contact in a direction in which the arc is stretched, and a second end opposed to the first end and arranged at a position away from the first end in the direction in which the arc is stretched.

* * * * *